US006647702B1

(12) United States Patent
Kim

(10) Patent No.: US 6,647,702 B1
(45) Date of Patent: Nov. 18, 2003

(54) AUTOMATIC TABLET DISPENSING AND PACKAGING SYSTEM

(76) Inventor: Jun Ho Kim, 100-23, Galsandong, Dalsuhgu, Taegu (KR)

( * ) Notice: Subject to any disclaimer, the term of this patent is extended or adjusted under 35 U.S.C. 154(b) by 0 days.

(21) Appl. No.: 10/278,495

(22) Filed: Oct. 23, 2002

(30) Foreign Application Priority Data

Oct. 23, 2001 (KR) ..... 10-2001-0065303

(51) Int. Cl.[7] ..... B65B 9/06

(52) U.S. Cl. ..... 53/568; 53/374.4; 53/75; 53/550; 53/562

(58) Field of Search ..... 53/75, 374.2, 374.3, 53/374.4, 375.4, 376.2, 548, 550, 551–555, 562, 568

(56) References Cited

U.S. PATENT DOCUMENTS 2,208,951 A * 7/1940 Tamassy ..... 53/134.2
2,994,996 A * 8/1961 Klar ..... 53/134.2
3,074,214 A * 1/1963 Schneider et al. ..... 53/552
3,546,849 A * 12/1970 Zimmerman ..... 53/374.4
3,850,780 A * 11/1974 Crawford et al. ..... 156/583.4
5,481,855 A * 1/1996 Yuyama ..... 53/493
5,722,215 A * 3/1998 Yuyama ..... 53/374.4
5,787,678 A * 8/1998 Koike et al. ..... 53/154
5,839,257 A * 11/1998 Soderstrom et al. ..... 53/411
5,875,610 A * 3/1999 Yuyama et al. ..... 53/75
6,170,229 B1 1/2001 Kim
6,202,385 B1 3/2001 Kim
6,216,418 B1 * 4/2001 Kim ..... 53/131.5
6,256,963 B1 * 7/2001 Kim ..... 53/155

FOREIGN PATENT DOCUMENTS

KR 10-2001-0065303 10/2001

* cited by examiner

*Primary Examiner*—Eugene Kim
*Assistant Examiner*—Hemant M Desai
(74) *Attorney, Agent, or Firm*—Park & Sutton LLP; John K. Park

(57) ABSTRACT

An automatic tablet dispensing and packaging system for processing a prescription input into tablet containing serial paper bags comprises a tablet dropping unit having a hopper guiding each tablet batch from the unit to drop therethrough, and shafts each having top and below-top peripheries and an axial line between the bottom and below-top peripheries. A top roller extends from the top periphery to have a top radius, an axial plate radially extends from the axial line to intermittently seal substantially folded paper sheet in a sidewise sealing format by mutual engagement rolling of the top rollers. Below-top rollers extend from the below-top periphery to have a below-top radius less than the top radius. Edge rollers provided below the below-top rollers to seal therebetween lengthwise sealing portions of the widthwisely sealed paper sheet.

15 Claims, 6 Drawing Sheets

AUTOMATIC TABLET DISPENSING AND PACKAGING SYSTEM

CLAIMING FOREIGN PRIORITY

The applicant claims and requests a foreign priority, through the Paris Convention for the Protection of Industry Property, based on a patent application filed in the Republic of Korea (South Korea) with the filing date of Oct. 23, 2001, with the patent application No. 10-2001-0065303, by the applicant. (See the attached Declaration)

BACKGROUND OF THE INVENTION

The invention relates to a tablet dispensing and packaging system. More particularly, the present invention relates to an automatic tablet dispensing and packaging system for processing a prescription input into serial paper bags where paper bags each containing a predetermined batch of tablets become evenly packaged regardless of difference in number of tablets being packaged.

FIGS. 4, 5 and 6 each show a conventional tablet packaging apparatus for an automatic tablet dispensing and packaging system. As shown FIG. 4, a paper sheet 100 being unrolled is initially sealed along an edge portion 100*a* by edge rollers 102 while receiving tablets 103 into the paper sheet being folded at the same time. The edge-sealed and folded paper sheet 100 is cross-sealed by the cross rollers 101. The distance between adjacent cross-sealed portions 100*b* is controlled by relative rolling of the edge rollers 102 and the cross rollers 101.

However, when the edge portions 100*a* are first sealed by the edge rollers 102, it may be difficult for the tablets 103 to drop down through a paper hole formed by the sealed edge portions 100*a* due to a relative narrowness of the hole, thereby incurring packaging errors. As shown in FIG. 5, the cross sealing by the cross rollers 101 is alternately performed prior to the edge sealing by the edge rollers 102. Here, the paper sheet 100 is relatively wide open when cross-sealed, so it is hard to evenly maintain the edge portions 100*a* of the paper sheet 100, thereby causing tablet bags to become defective especially when more tablets are assigned to the tablet bags. Also, as shown in FIG. 6, the heater 113 is installed within the cross rollers 101 powered by a first motor 111 so that the heat may be transferred via the cross rollers 101 to the edge rollers 102, disadvantageously causing temperature difference between the edge and cross rollers.

SUMMARY OF THE INVENTION

The present invention is contrived to overcome the conventional disadvantages. Accordingly, it is an object of the present invention to stably guide the paper bag into sealing rollers. Another object is to minimize defective paper bags each containing a predetermined batch of tablets.

To achieve the above-described objects, an automatic tablet dispensing and packaging system for processing a prescription input into tablet containing serial paper bags according to the present invention comprises a tablet dropping unit having a hopper therebelow. The hopper guides each batch of tablets from the table dropping unit to drop therethrough. Each batch of tablets are determined in accordance with the prescription input.

A paper control is provided below the hopper to substantially fold an elongated paper sheet being unrolled to consecutively capture thereby said each batch of tablets from the hopper. The paper sheet includes a lengthwise sealing portion along each upper edge line of the substantially folded paper sheet. A pair of shafts each having a top periphery, a below-top periphery, a bottom periphery, and an axial line between the bottom and below-top peripheries. A top roller extends from the top periphery of each shaft to have a top radius. An axial plate radially extends from the axial line of each shaft so that ridged outer surfaces of the axial plates intermittently seal the substantially folded paper sheet in a sidewise sealing format in correspondence to mutual engagement rolling of the top rollers.

A pair of below-top rollers extending from the below-top periphery to have a below-top radius. The below-top radius is less than the top radius so that the below-top rollers guide down the sealing portions of the paper sheet therebetween. Also, a pair of edge rollers provided below the below-top rollers to seal therebetween the lengthwise sealing portions of the widthwisely sealed paper sheet to thereby release the tablet containing serial paper bags.

The below-top rollers are spaced from each other by between about twice the thickness of the paper sheet and about six times the thickness of the paper sheet. Each pair of the top and edge rollers are each elastically engaged to each other. A bottom roller extending from the bottom periphery of said each shaft to have a bottom radius so that the bottom radius is equal to the top radius. Selectively, a roller control is attached to the top and edge rollers to temporarily halt the engagement rolling of the top and edge rollers for a length adjustment between two adjacent ones of the widthwisely sealed portions of the paper sheet. A heater may be provided to heat each outer surface of the axial plates and the edge rollers. Preferably, each batch of tablets is variable in number of tablets assigned therefore.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
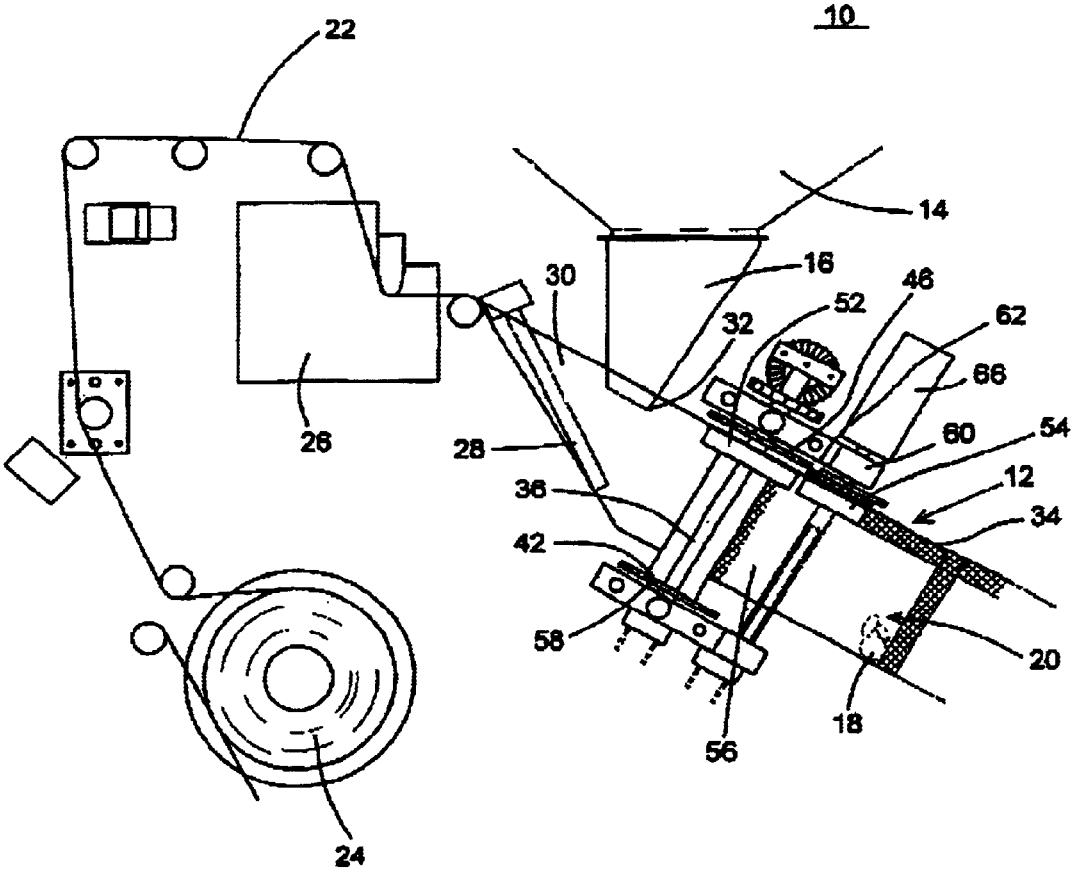
FIG. 1 is a schematic view showing an automatic tablet dispensing and packaging system for processing a prescription input into tablet containing serial paper bags according to the present invention.

FIG. 1 shows a tablet packaging mechanism of an automatic tablet dispensing and packaging system 10 for processing a prescription input into tablet containing serial paper bags 12 according to the present invention. As shown therein, the tablet dispensing and packaging system 10 comprises a tablet dropping unit 14 having a hopper 16 therebelow. The hopper 16 serves to guide tablets 18 downward. That is, the hopper 16, guides each batch 20 of tablets 18 from the table dropping unit 14 to drop therethrough.

Each tablet batch 20 is to constitute a single dose packaged in a selected one of the serial paper bags 12. Here, each tablet batch 20 is determined in accordance with the prescription input which then commands the tablet dropping unit 14 for tablet releasing or dropping. The tablet paper bags 12 are formed of a paper sheet 22 being released from a paper roll 24. The paper sheet 22 unrolled from the paper roll 24 is sequentially printed thereon by a printer 26 for prescription information and/or instructions for patients.

A paper control 28 is provided below the hopper 16 for paper control. Specifically, the paper control 28 serves to turn the flat paper sheet 22 to a substantially folded paper sheet 30. Namely, the paper control 28 centrally presses the flat paper sheet 22 to substantially fold the elongated, flat paper sheet 22 being unrolled from the paper roll 24 to consecutively capture thereby each batch 20 of tablets 18 from the hopper 16. The substantially folded paper sheet 30 is partitioned to include a lengthwise sealing portion 32 along each upper edge line 34 of the substantially folded paper sheet 30.

Figure 2:
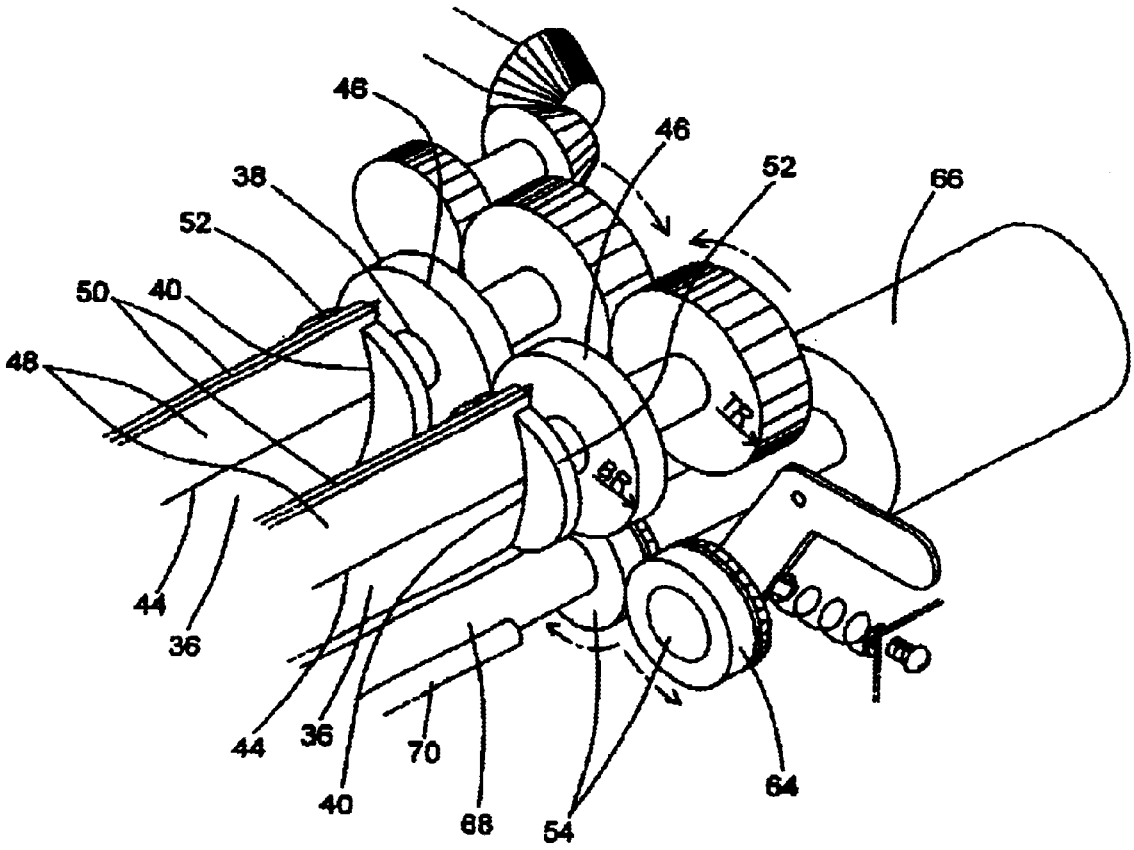
FIG. 2 is a perspective view showing roller mechanism according the present invention.
Figure 3:
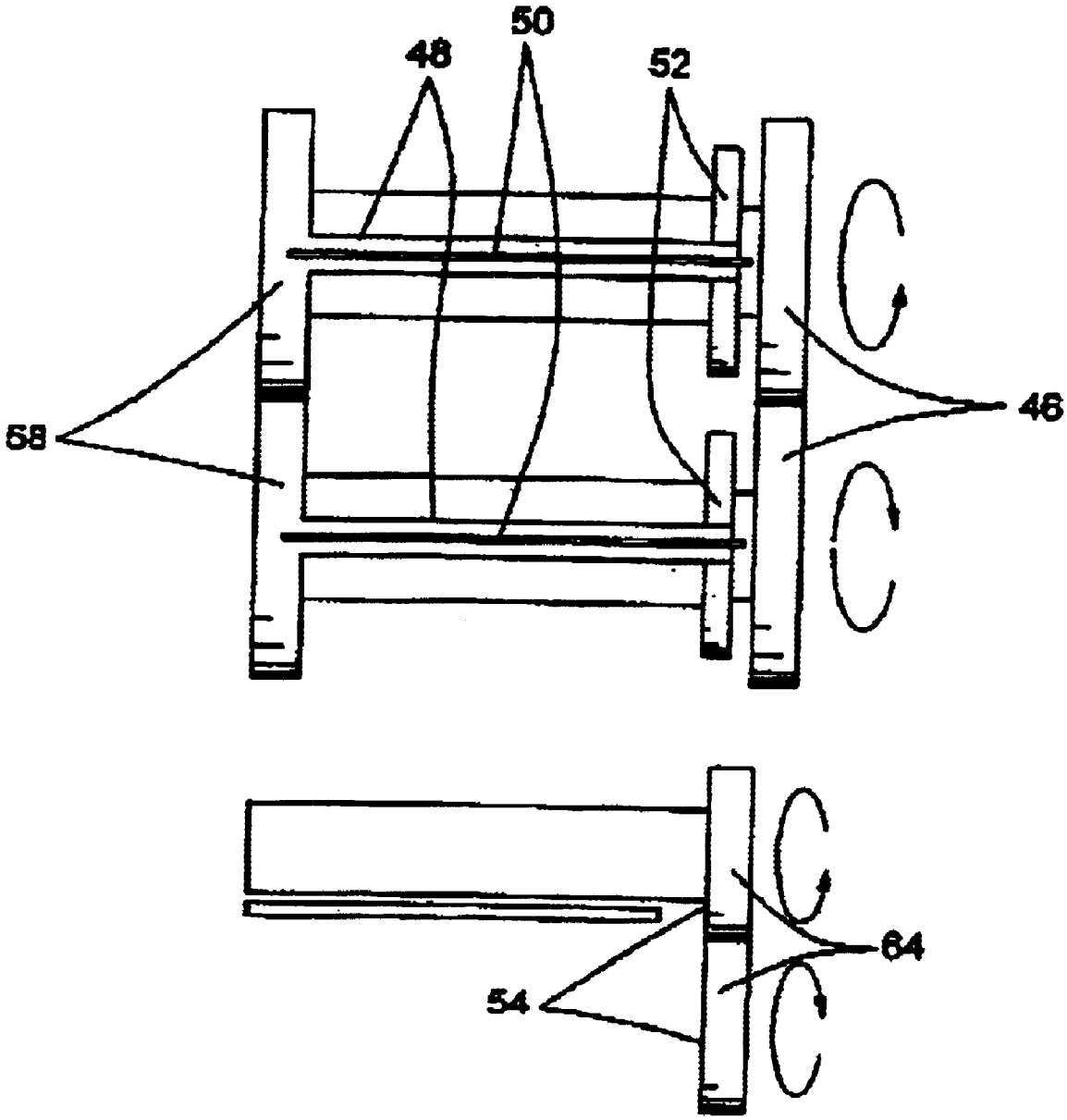
FIG. 3 is a schematic view showing roller mechanism according to the present invention.
Figure 4:
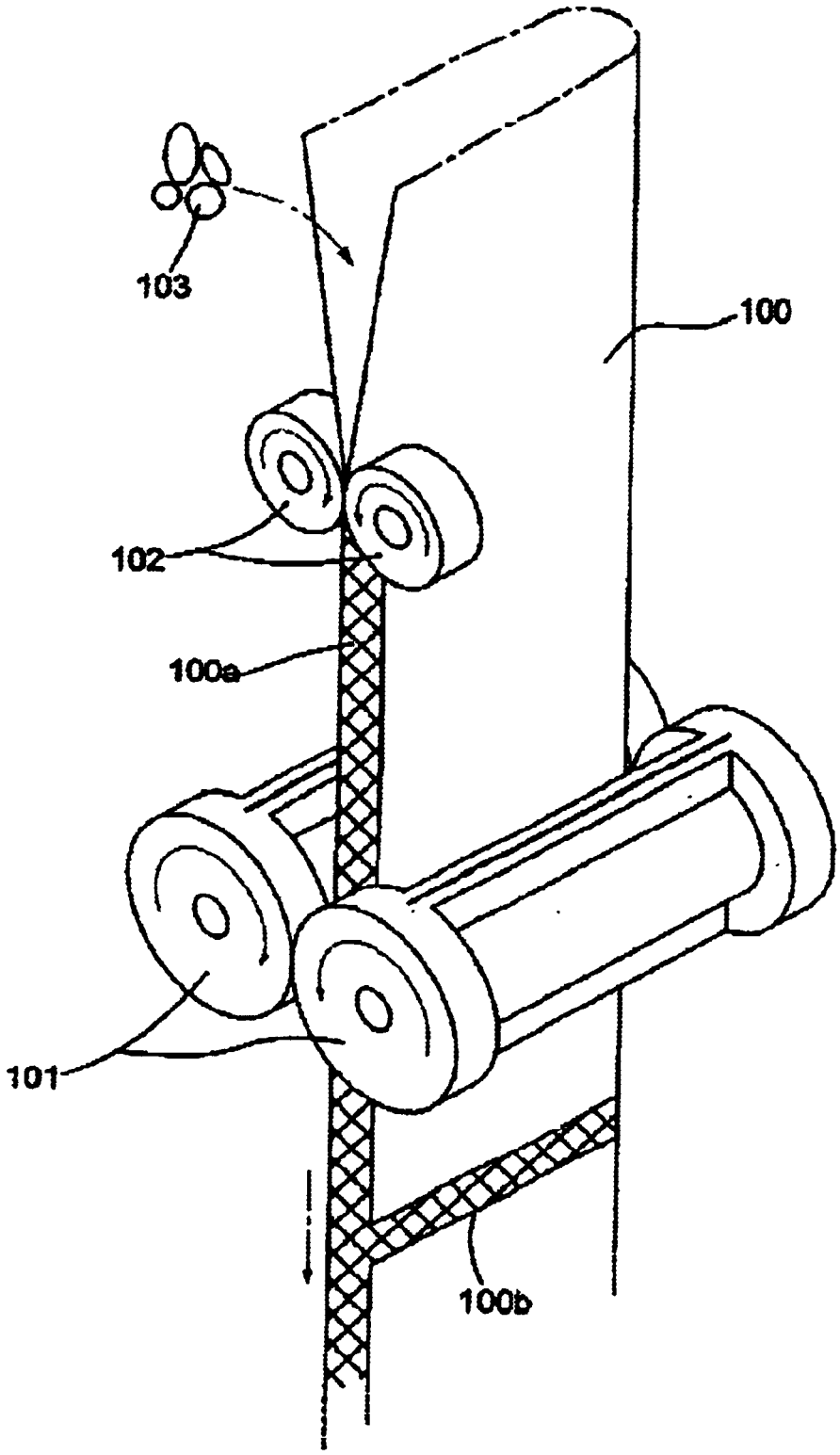
FIG. 4 Prior Art
FIGS. 4–6 are views each showing conventional roller mechanism for a tablet packaging apparatus.
Figure 5:
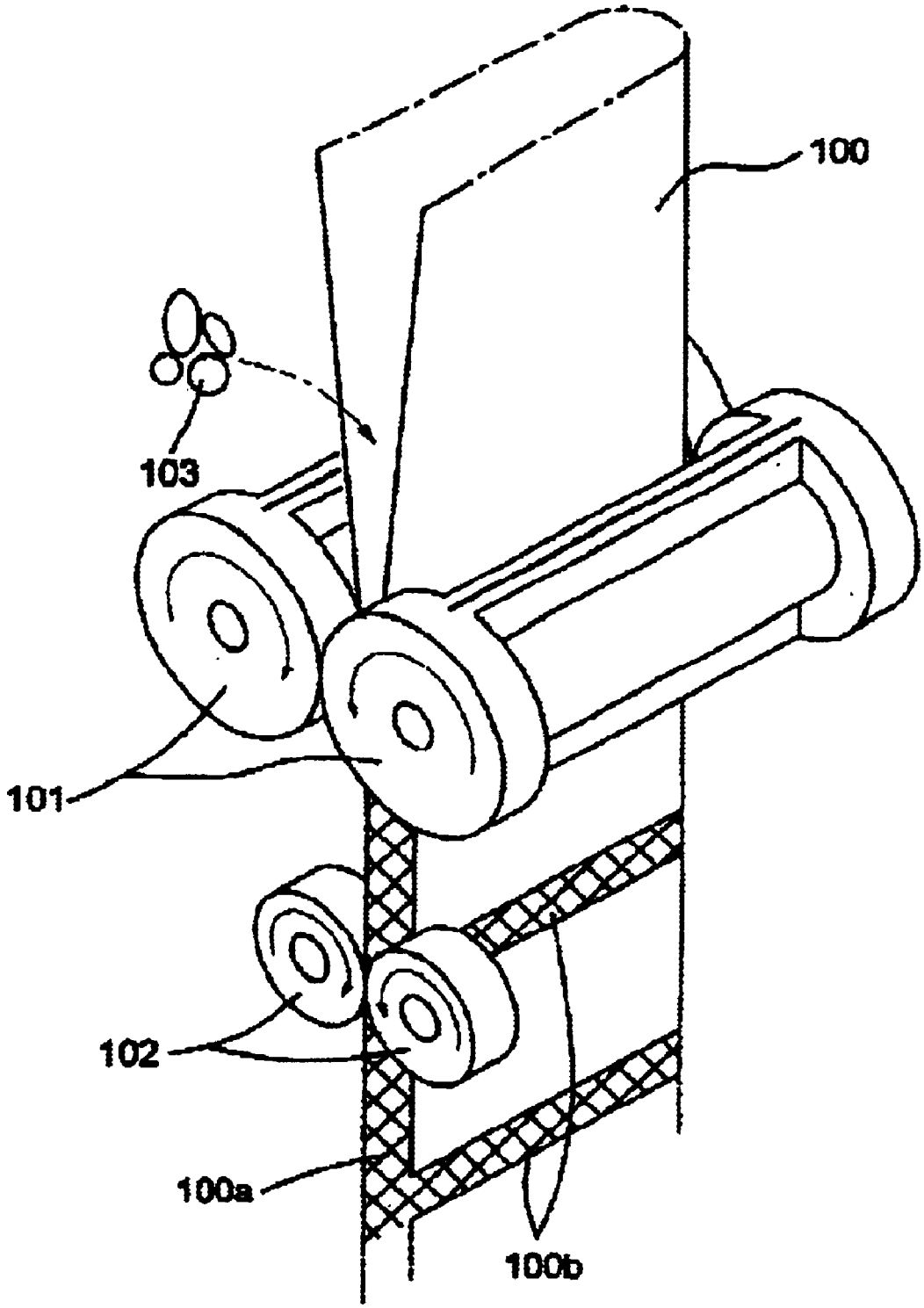
FIG. 5 Prior Art
Figure 6:
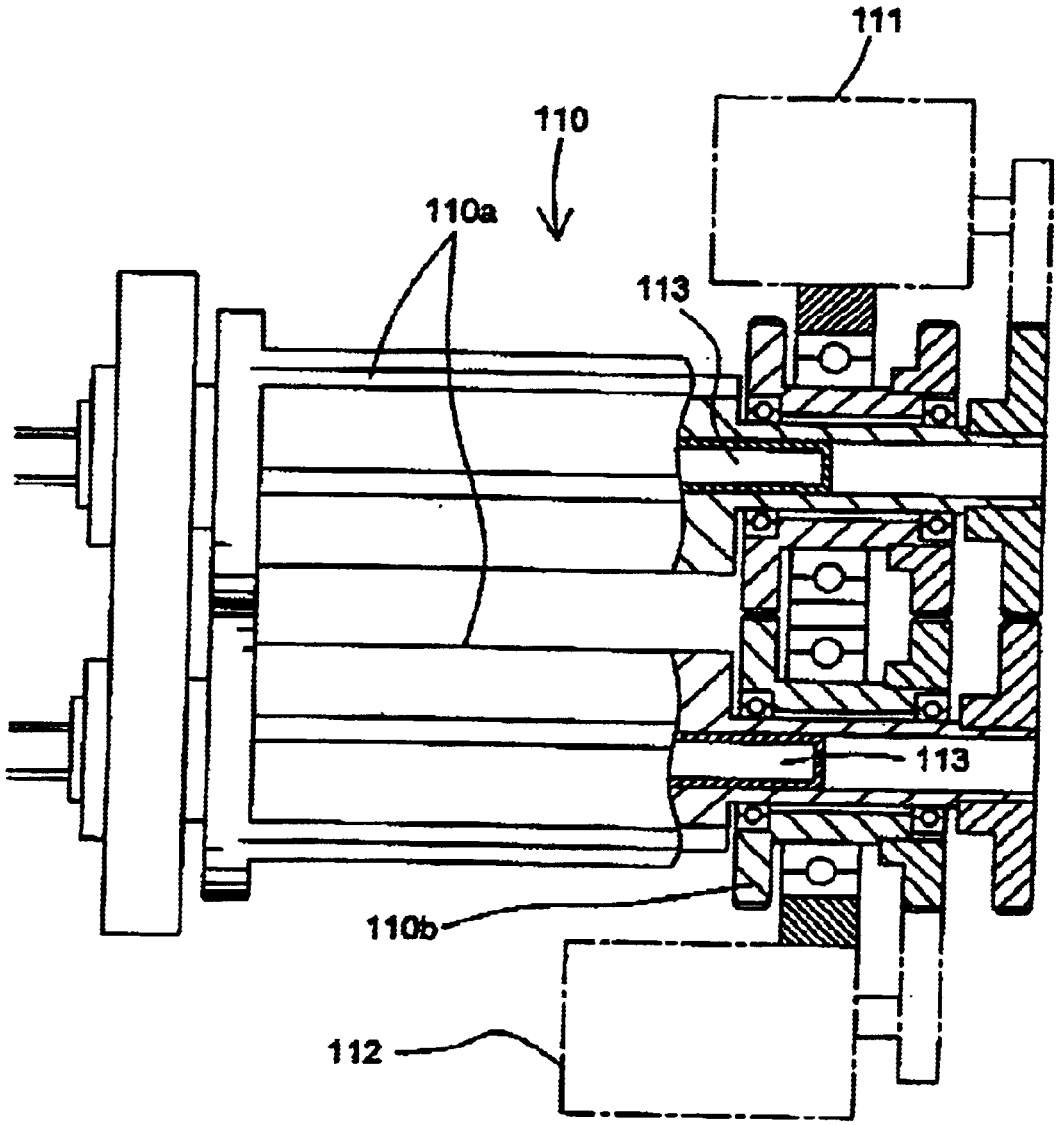
FIG. 6 Prior Art

FIGS. 2 and 3 show specified views for tablet packaging mechanism further to FIG. 1. As shown therein, a pair of shafts 36 are provided below the hopper 16 to align in a substantial slanting format to facilitate the substantially folded paper sheet 30 to capture the tablets 18. Each shaft 36 is defined to have a top periphery 38, a below-top periphery 40, a bottom periphery 42, and an axial line 44 between the bottom and below-top peripheries 42, 40. In this construction, a top roller 46 extends from the top periphery 38 of each shaft 36 to have a top radius TR. An axial plate 48 radially extends from the axial line 44 of each shaft 36 so that ridged outer surfaces 50 of the axial plates 48 intermittently seal the substantially folded paper sheet 30 in a sidewise sealing format in correspondence to mutual engagement rolling of the top rollers 46. For a better performance, the top rollers 46 may be elastically engaged to each other.

A pair of below-top rollers 52 each extend from the below-top periphery 40 to have a below-top radius BR. Here, the below-top radius BR is less than the top radius TR so that the below-top rollers 52 guide down the sealing portions 32 of the substantially folded paper sheet 30 therebetween. On the other hand, a pair of edge rollers 54 are provided below the below-top rollers 52 to seal therebetween the lengthwise sealing portions 32 of the widthwisely sealed paper sheet 56 to thereby release the tablet containing serial paper bags 12. Here, it is preferred that the edge rollers 54 are elastically engaged to each other.

In a preferred version, the below-top rollers 52 are spaced from each other by between about twice the thickness of the paper sheet 22 and about six times the thickness of the paper sheet 22. It is recommended that the below-top rollers 52 are spaced from each other by about three times the thickness of the paper sheet 22. The below-top rollers 52 serve to stably guide the edge portions 32 of the substantially folded paper sheet 30 and to prevent the edge portions 32 from losing a linearly even alignment especially when tablet batch 20 is large. Here, each batch 20 of tablets 18 is variable in number of tablets assigned therefor. The assigned tablets for each batch 20 may be determined in accordance with the tablet prescription input. Consequently, the number of the assigned tablets for each batch 20 determines the length between two adjacent ones of the widthwisely sealed portions 56 of the substantially folded paper sheet 30.

Specifically, in case a tablet batch 20 includes a larger number of tablets 18, the substantially folded paper sheet 30 becomes sidewisely swollen to consequently cause the edge portions 32 to wrinkle or crumble in the conventional packaging mechanism lacking the below-top rollers 52, thereby causing defective paper bags resulting from incomplete sealing and wrinkled sealing.

The below-top rollers 52 in the present invention are focused on eliminating wrinkling or crumbling of the edge portions 32 of the substantially folded paper sheet 30 for quality tablet packaging, without regard to irregularity of tablet batches in terms of the number of tablets.

In an embodiment, a bottom roller 58 is formed to extend from the bottom periphery 42 of each shaft 36 to have a bottom radius BR, wherein the bottom radius BR is equal to the top radius TR to stabilize widthwise or cross sealing of the substantially folded paper sheet 30. Also, a roller control 60 may be attached to the top and edge rollers 46, 54. the roller control 60 temporarily halts the engagement rolling of the edge rollers 54 for a length adjustment between two adjacent ones of the widthwisely sealed portions 56 of the substantially folded paper sheet 30. Alternately, the roller control 60 temporarily halts the engagement rolling of the top rollers 46 for a length adjustment between two adjacent ones of the widthwisely sealed portions 56 of the substantially folded paper sheet 30.

A heater 62 may be provided adjacent to the top and edge rollers 46, 54 to heat each outer surface 50, 64 of the axial plates 48 and the edge rollers 54. Here, the paper sheet 22 is heat-sensitive to become substantially adhesive when heated. In other words, the heat-sensitive paper sheet 22 is coated by glue and dried so as to become active when heated. Subsequently, when the axial plates 48 make a mutual engagement rolling in accordance with the mutual rolling of the top rollers 46, the outer surfaces 50 of the axial plates 48 heatingly seal the substantially folded paper sheet 30 in a widthwise sealing format while the below-top rollers 52 guide the edge portions 32 of the substantially folded paper sheet 30, then the edge rollers 54 positioned straight below the below-top rollers 52 make a mutual rolling generated by the motor 66.

One of the edge rollers 54 may be carried on a heating rod 68 that delivers heat from the heater 62 to the outer surfaces 64 of the edge rollers 54. In order to protect the widthwisely sealed paper sheet 56 a divider 70 may be provided adjacent to the heating rod 68 to prevent the cross sealed paper sheet 56 from approaching the heating rod 68.

As discussed above, the tablet packaging mechanism according to the present invention enables the below-top rollers 52 to stably guide the substantially folded paper sheet 30 without wrinkling or crumpling of the edge portions 32 of the paper sheet 30 whether the assigned tablet batch 20 is large or small in number of tablets, thereby minimizing defective paper bags.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. An automatic tablet dispensing and packaging system for processing a prescription input into tablet containing serial paper bags, comprising:

a) a tablet dropping unit having a hopper therebelow, wherein the hopper guides each batch of tablets from the table dropping unit to drop therethrough, wherein said each batch of tablets are determined in accordance with the prescription input;

b) a paper control provided below the hopper to substantially fold an elongated paper sheet being unrolled to consecutively capture thereby said each batch of tablets from the hopper, wherein the paper sheet includes a lengthwise sealing portion along each upper edge line of the substantially folded paper sheet;

c) a pair of shafts each having a top periphery, a below-top periphery, a bottom periphery, and an axial line between the bottom and below-top peripheries, wherein a top roller extends from the top periphery of said each shaft to have a top radius, wherein an axial plate radially extends from the axial line of said each shaft so that ridged outer surfaces of the axial plates intermittently seal the substantially folded paper sheet in a sidewise sealing format in correspondence to mutual engagement rolling of the top rollers;

d) a pair of below-top rollers extending from the below-top periphery to have a below-top radius, wherein the below-top radius is less than the top radius so that the below-top rollers guide down the sealing portions of the paper sheet therebetween; and e) a pair of edge rollers provided below the below-top rollers to seal therebetween the lengthwise sealing portions of the widthwisely sealed paper sheet to thereby release the tablet containing serial paper bags.

2. The system of claim 1 wherein the below-top rollers are spaced from each other by between about twice the thickness of the paper sheet and about six times the thickness of the paper sheet.

3. The system of claim 1 wherein the below-top rollers are spaced from each other by about three times the thickness of the paper sheet.

4. The system of claim 1 wherein the top rollers are elastically engaged to each other.

5. The system of claim 1 further comprising a bottom roller extending from the bottom periphery of said each shaft to have a bottom radius, wherein the bottom radius is equal to the top radius.

6. The system of claim 1 further comprising a roller control attached to the top and edge rollers, wherein the roller control temporarily halts the engagement rolling of the edge rollers for a length adjustment between two adjacent ones of the widthwisely sealed portions of the paper sheet.

7. The system of claim 6 wherein the roller control temporarily halts the engagement rolling of the top rollers for a length adjustment between two adjacent ones of the widthwisely sealed portions of the paper sheet.

8. The system of claim 1 further comprising a heater to heat each outer surface of the axial plates and the edge rollers.

9. The system of claim 1 wherein the paper sheet is heat-sensitive.

10. The system of claim 9 wherein the heat-sensitive paper sheet is coated by glue and dried.

11. The system of claim 1 wherein said each batch of tablets is variable in number of tablets assigned therefor.

12. The system of claim 11 wherein the assigned tablets for said each batch is determined in accordance with the tablet prescription input.

13. The system of claim 12 wherein the number of the assigned tablets for said each batch determines the length between two adjacent ones of the widthwisely sealed portions of the paper sheet.

14. The system of claim 13 wherein the paper sheet is heat-sensitive.

15. The system of claim 14 wherein the heat-sensitive paper sheet is coated by glue and dried.

* * * * *